US006382999B1

(12) United States Patent
Mou et al.

(10) Patent No.: US 6,382,999 B1
(45) Date of Patent: May 7, 2002

(54) ANTI-SPARK POWER JACK

(75) Inventors: Zhiquan Mou; ZiQiang Zhu, both of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/930,642

(22) Filed: Aug. 14, 2001

(30) Foreign Application Priority Data

Sep. 29, 2000 (TW) ..... 89216956 U

(51) Int. Cl.[7] ..... H01R 29/00
(52) U.S. Cl. ..... 439/188; 200/51.09; 439/944
(58) Field of Search ..... 439/188, 944, 439/63; 200/51.09

(56) References Cited

U.S. PATENT DOCUMENTS 5,007,851 A * 4/1991 Matsumoto ..... 439/188
5,927,999 A * 7/1999 Shimojyo ..... 439/63

* cited by examiner

*Primary Examiner*—Brian Sircus
*Assistant Examiner*—Javaid Nasri
(74) *Attorney, Agent, or Firm*—Wei Te Chung

(57) ABSTRACT

A direct-current power jack includes an insulative housing, a hole defined in a front face of the housing for insertion of a complementary power plug thereinto, a ground contact, a center contact, two switch contacts, two conductive contacts, and a joining member. When the plug is inserted into the power jack, the plug electrically connects firstly with the ground contact. The plug then electrically connects with the center contact. The plug then pushes the first switch contact to cause the first conductive contact to electrically connect with the joining member, and then pushes the second switch contact to cause the second conductive contact to electrically connect with the joining member. An electrical circuit electrically connecting with the power jack includes a ground circuit, a resistor, a capacitor and a load. The power jack prevents in-rush current sparking when it is engaged with the plug.

1 Claim, 6 Drawing Sheets

ANTI-SPARK POWER JACK

BACKGROUND OF THE INVENTION

1. Field of the Invention

The present invention relates to power jack electrical connectors, and more particularly to direct-current power jacks susceptible to in-rush current sparking when mating with a complementary power plug.

2. Description of the Related Art

A typical direct-current (DC) power jack includes a central contact and spring contacts for electrically engaging with a direct-current power plug. A conventional DC power jack, such as that disclosed in U.S. Pat. No. 5,927,999, has three movable spring contacts around the central contact. When mating with a power plug, the three spring contacts simultaneously engage with a corresponding terminal of the plug. Such multi-point contacting allows a larger current to flow from the plug to the jack.

Another conventional DC power jack, such as that disclosed in U.S. Pat. No. 5,007,851, includes a central contact, a fixed tab contact and a movable spring contact. The tab contact and the spring contact function as a switch so that a circuit can detect whether the jack has properly engaged with a power plug. When the jack is not engaged with a plug, the spring contact contacts the tab contact. When the plug is inserted into the jack, the spring contact separates from the tab contact.

In the above two conventional power jacks, electrical connection between the plug and the jack is established immediately upon the contacts thereof engaging together. There is frequently a high voltage difference between the contact of the plug and the contact of the jack. Instantaneous electrical connection therefore often causes an in-rush current spark to jump from the contact of the plug to the contact of the jack. Such sparking degrades the contacting characteristics of the contacts, and increases the resistance of the contacts. Furthermore, repeated sparking can eventually result in malfunction of both the jack and the plug. Accordingly, a DC power jack that eliminates in-rush current sparking is desired.

SUMMARY OF THE INVENTION

In view of the foregoing, a main object of the present invention is to provide a direct-current (DC) power jack which prevents in-rush current sparking when the power jack engages with a power plug.

To achieve the above-mentioned object, a DC power jack in accordance with the present invention includes an insulative housing and a hole defined in a front face of the housing for insertion of a complementary power plug thereinto. The power jack also includes a ground contact, a center contact, first and second switch contacts, first and second conductive contacts and a joining member. When the plug is inserted into the power jack, it electrically connects firstly with the ground contact. The plug then electrically connects with the center contact. The plug then pushes the first switch contact to cause the first conductive contact to electrically connect with the joining member, and then pushes the second switch contact to cause the second conductive contact to electrically connect with the joining member.

An electrical circuit electrically connected with the power jack includes a ground circuit, a resistor, a capacitor and a load. The ground circuit connects with the ground contact. When the plug electrically connects with the center contact, power from the plug flows through the center contact and the resistor to charge the capacitor. When the first conductive contact connects with the joining member, power from the plug flows through the center contact, the joining member and the first conductive contact to charge the capacitor. When the second conductive contact connects with the joining member, power accumulated in the capacitor flows through the resistor and the second conductive contact to the load.

DETAILED DESCRIPTION OF THE PREFERRED EMBODIMENT

Figure 2:
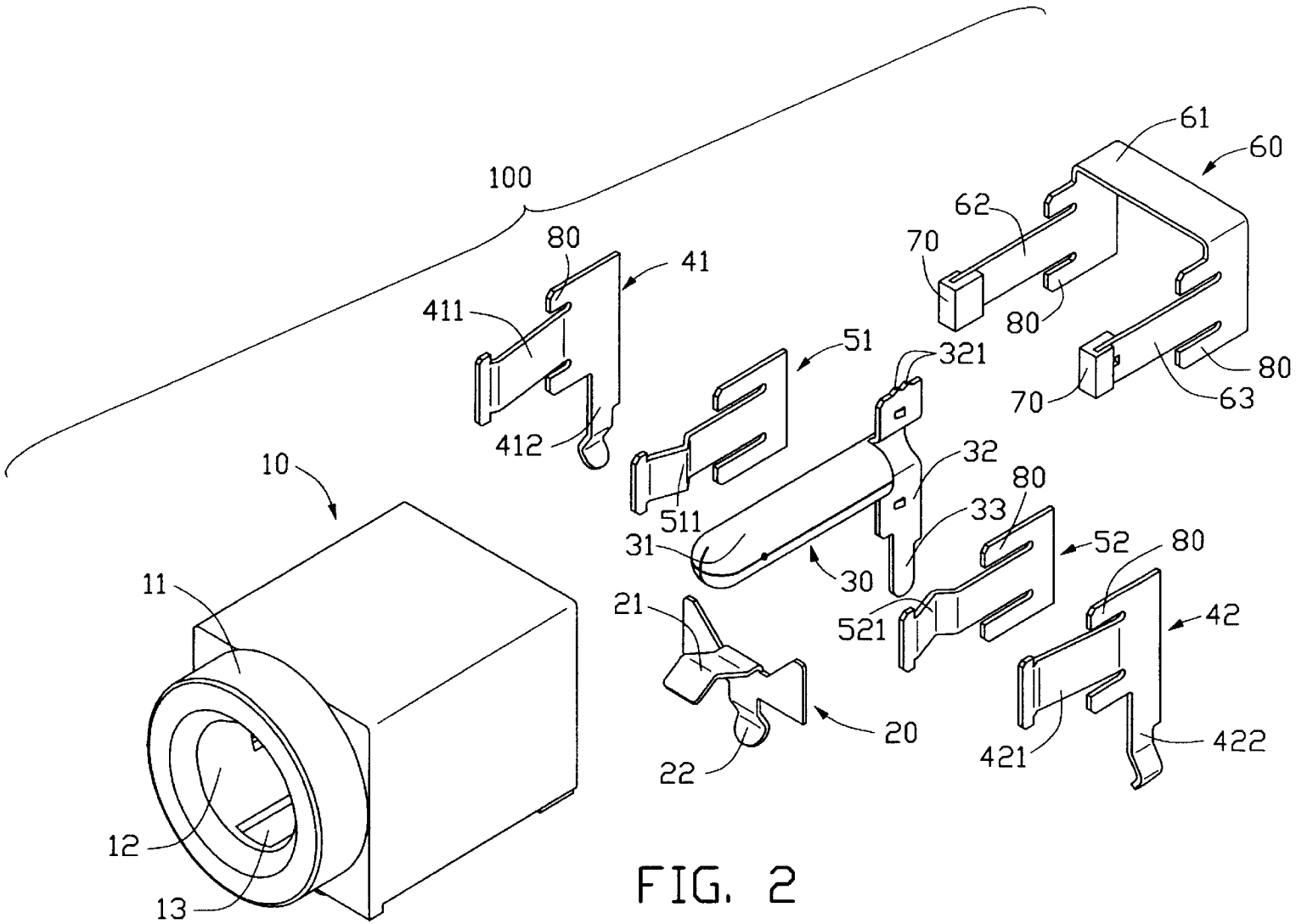
FIG. 2 is an exploded perspective view of the power jack of FIG. 1.

Referring particularly to FIG. 2, a direct-current power jack 100 of the present invention includes a dielectric housing 10, a ground contact 20, a generally Tshaped center (main) power contact 30, two (secondary) conductive contacts 41, 42, two switch contacts 51, 52 and a generally U-shaped joining member 60.

Figure 1:
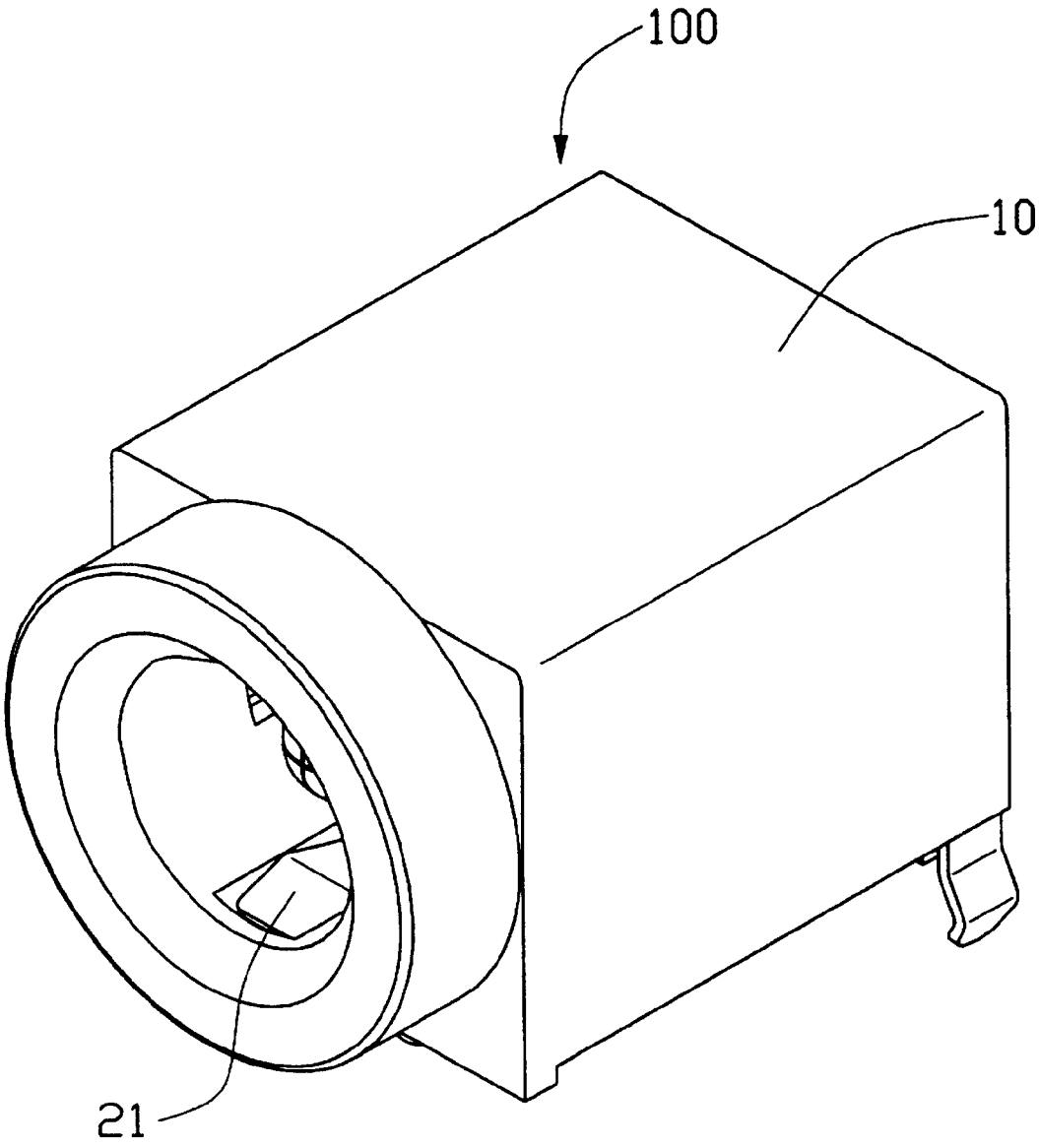
FIG. 1 is an assembled perspective view of a direct-current power jack in accordance with the present invention.
Figure 3:
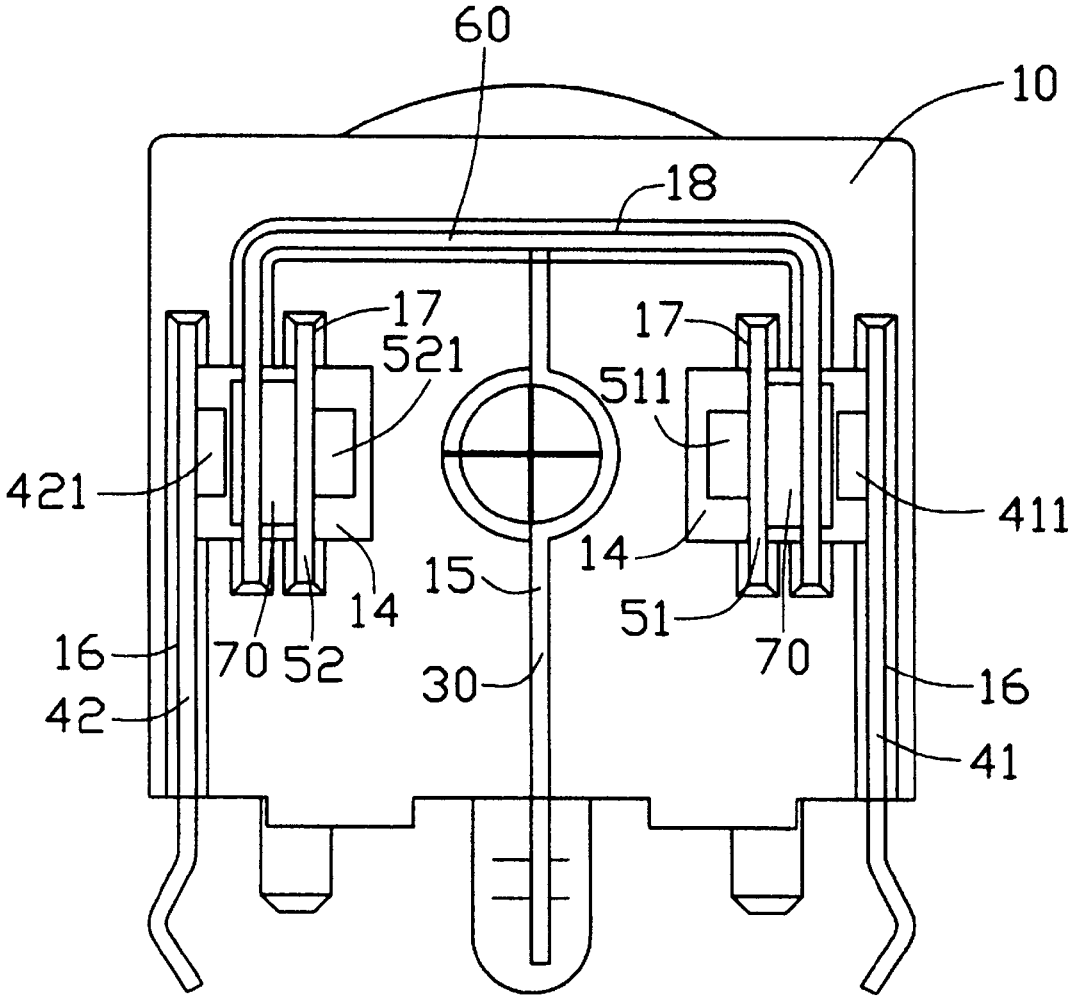
FIG. 3 is a rear plan view of the power jack of FIG. 1.
Figure 4:
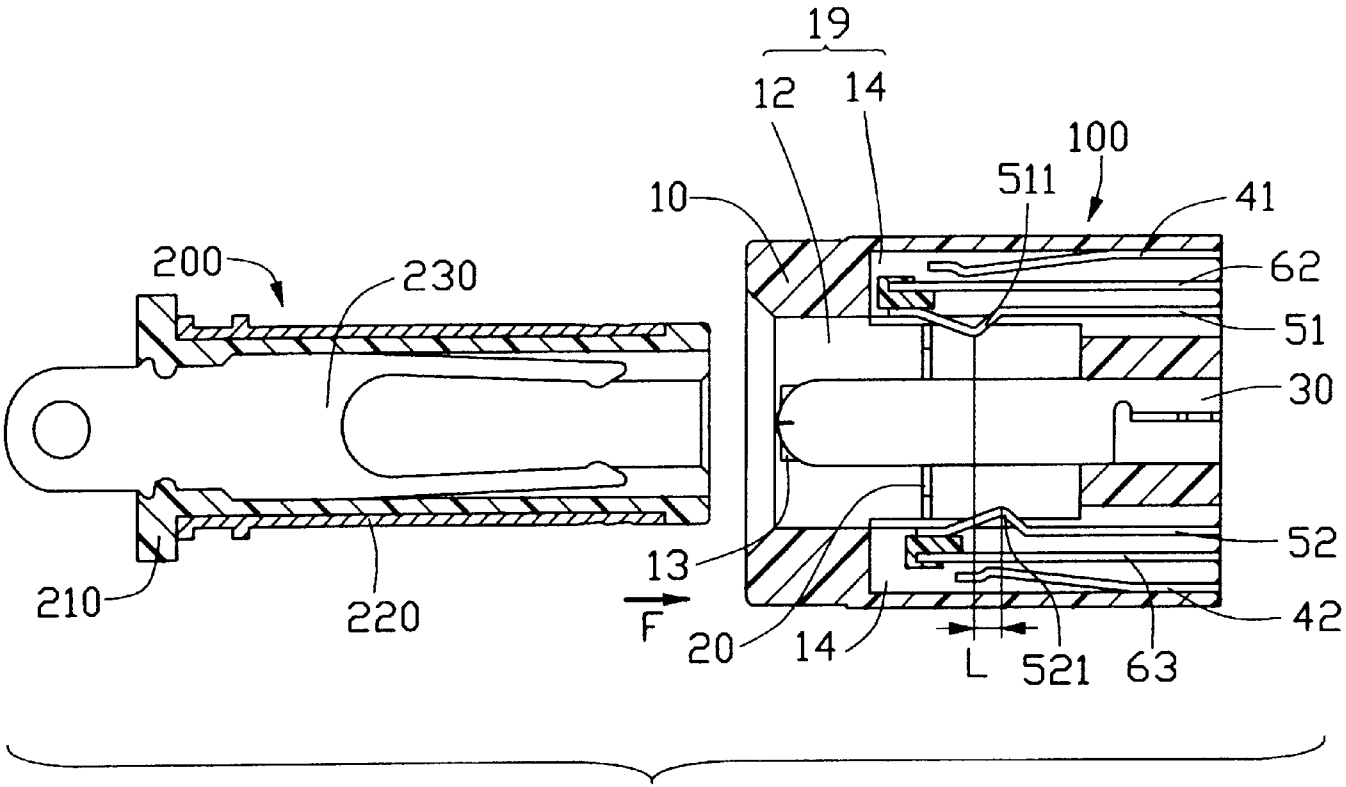
FIG. 4 is a cross-sectional view of the power jack of FIG. 1 ready to be connected with a complementary power plug.

Referring also to FIGS. 1, 3 and 4, the housing 10 has an annular interface portion 11 and a cavity 19. The interface portion 11 is at a front of the housing 10. The cavity 19 comprises a central cylindrical hole 12, and a pair of box-shaped cutouts 14 (best shown in FIG. 4). The hole 12 is defined in a front face of the housing 10. The cutouts 14 are defined in respective opposite sidewalls of the housing 10, and are in communication with the hole 12. The hole 12 is used to receive a complementary direct-current modular power plug 200 (see FIG. 4). A mounting portion 13 in the form of a slot is defined in a bottom of the interface portion 11. The cutouts 14 respectively movably receive the conductive contacts 41, 42, switch contacts 51, 52 and arms 62, 63 (see FIG. 4) of the joining member 60. A vertical slot 15 is defined in a rear of the housing 10, for fixedly receiving the center contact 30. A pair of vertical grooves 16 is defined in the rear of the housing 10, for fixedly receiving the conductive contacts 41, 42. A pair of vertical grooves 17 is defined in the rear of the housing 10, for fixedly receiving the switch contacts 51, 52. A U-shaped groove 18 is defined in the rear of the housing 10, for fixedly receiving the joining member 60.

The ground contact 20 comprises a grounding tab 21 and a foot 22. The ground contact 20 is mounted in the mounting portion 13. The grounding tab 21 projects upwardly into the hole 12 and the foot 22 depends below the housing 10 for soldering to a printed circuit board(PCB) (not shown) on which the jack 100 is mounted.

The center contact 30 comprises a front horizontal touch post 31 and a rear vertical plate 32. The plate 32 has a plurality of protrusions 321 formed on a top thereof, and a foot 33 depending from a bottom thereof. The plate 32 is fixedly fitted in the slot 15, and the touch post 31 extends into the hole 12. The foot 33 protrudes below the housing 10, for soldering to a printed circuit of the PCB.

The conductive contacts 41, 42 respectively comprise touch pads 411, 421 and feet 412, 422. The touch pads 411, 421 are deflected inwardly at a predetermined angle relative to the feet 412, 422, respectively, and are resiliently movable within the cutouts 14 respectively.

The switch contacts 51, 52 respectively have inwardly-protruding engaging portions 511, 521. When assembled in the housing 10, the switch contacts 51, 52 are located inwardly from the conductive contacts 41, 42 respectively. The engaging portions 511, 521 of the switch contacts 51, 52 respectively protrude into the hole 12, so that the switch contacts 51, 52 can be resiliently bent outwardly by the plug 200 when the plug 200 is inserted into the jack 100.

The joining (connection) member 60 is used to transmit power to the conductive contacts 41, 42. The joining member 60 has a central horizontal beam 61, and two arms 62, 63 extending forwardly from opposite ends of the beam 61 respectively. An insulative block 70 is attached to a front end of each arm 62, 63. The beam 61 contacts the protrusions 321 of the center contact 30 to establish electrical contact therebetween. As shown in FIG. 4, the arms 62, 63 extend in the cutouts 14 between the touch pads 411, 421 and the engaging portions 511, 521. The insulative blocks 70 prevent the arms 62, 63 from electrically contacting the engaging portions 511, 521. When the plug 200 is inserted into the jack 100, the arms 62, 63 are driven by the switch contacts 51, 52 to engage with the touch pads 411, 421 (refer to the description concerning FIG. 5 which follows).

A pair of latching projections 80 is formed on each switching contact 51, 52, each conductive contact 41, 42, and each arm 62, 63, for interferential fitting in the corresponding grooves 16, 17, and 18 of the housing 10 respectively. The switch contacts 51, 52, the conductive contacts 41, 52 and the joining member 60 are thereby respectively fixed to the housing 10.

Figure 5:
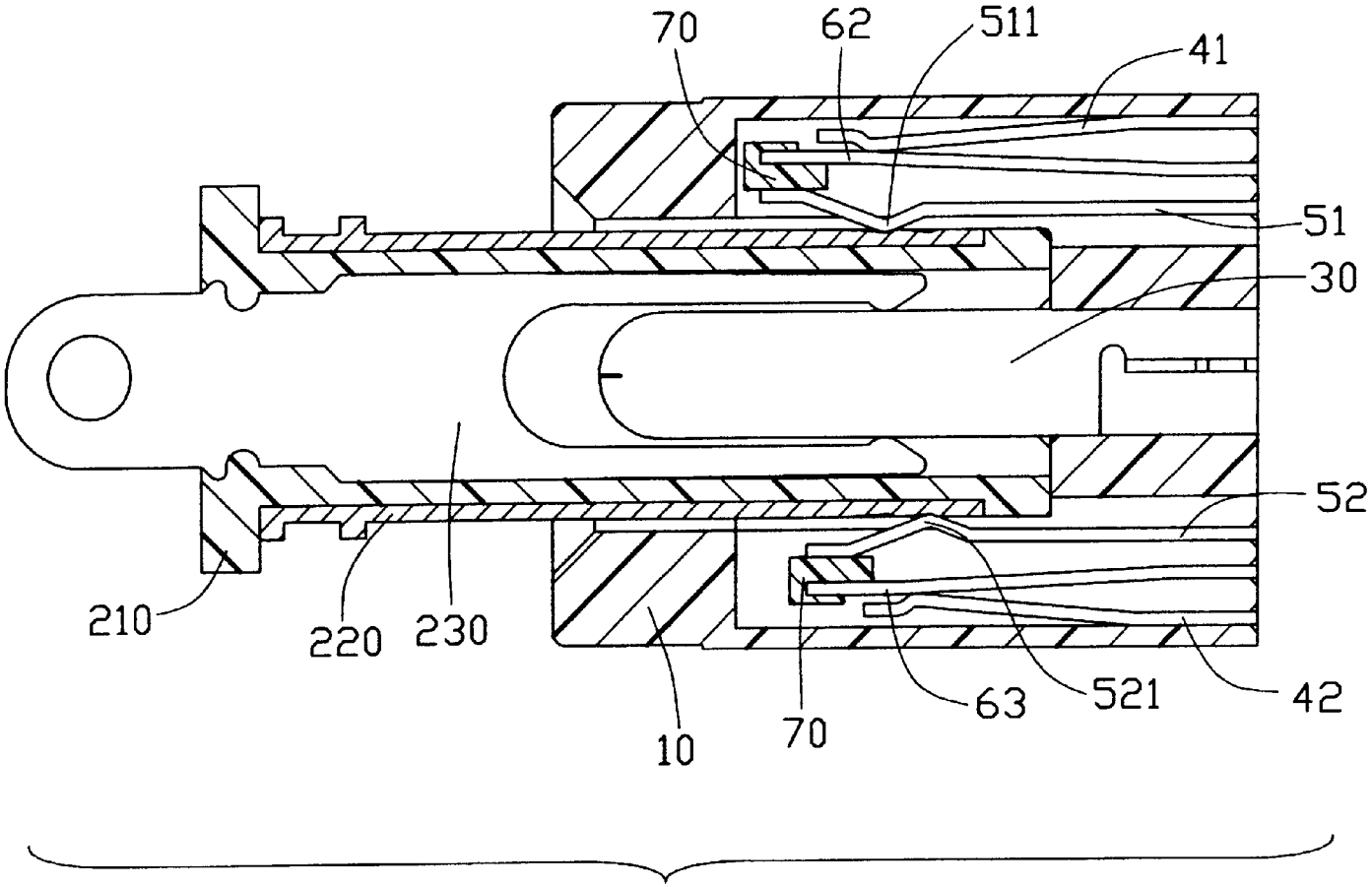
FIG. 5 is similar to FIG. 4, but showing the power jack and the power plug connected together.

Referring particularly to FIG. 5, the plug 200 comprises a dielectric housing 210, a conductive sleeve 220 enclosing the dielectric housing 210, and an annular power terminal 230 mounted in the dielectric housing 210. The plug 200 is inserted into the jack 100 in direction F (see FIG. 4), The conductive sleeve 220 first contacts with the ground contact 20, and then the terminal 230 contacts with the touch post 31 of the center contact 30. Then, the conductive sleeve 220 pushes the engaging portion 511 of the switch contact 51 outwardly. A distance D (not shown in FIG. 4) is defined between a point where the terminal 230 first contacts the touch post 31 and an inmost contact apex of the engaging portion 511. The distance D is measured along an axial direction of the housing 10. The front end of the switch contact 51 accordingly pushes the insulative block 70 on the arm 62 outwardly The arm 62 is accordingly pushed outwardly to electrically engage with the conductive contact 41. Then, the conductive sleeve 220 pushes the engaging portion 521 of the switch contact 52 outwardly. The switch contact 52 accordingly pushes the insulative block 70 on the arm 63 outwardly. The arm 63 is accordingly pushed outwardly to electrically engage with the conductive contact 42. A distance L (see FIG. 4) is defined between inmost contact apexes of the engaging portions 511, 521. The distance L is measured along an axial direction of the housing 10. Finally, a centermost contact portion of the terminal 230 of the plug 200 abuts against a free end of the touch post 31.

Figure 6:
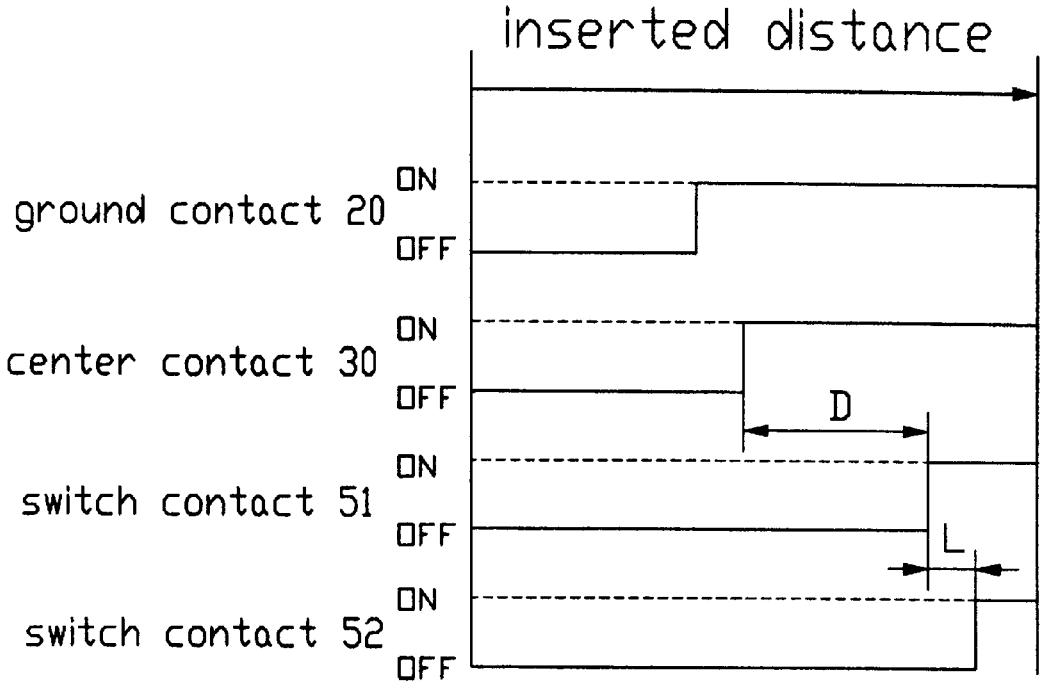
FIG. 6 is a diagram showing a relationship between a distance of insertion of the power plug into the power jack and a status of various contacts of the power jack.

FIG. 6 shows a relationship between a distance of insertion of the plug 200 into the jack 100, and a status of the various contacts of the jack 100. The status of each contact can be either "ON" or "OFF." This means that the relevant contact is either in contact with or separated from the conductive sleeve 220 of the plug 200, respectively.

Figure 7:
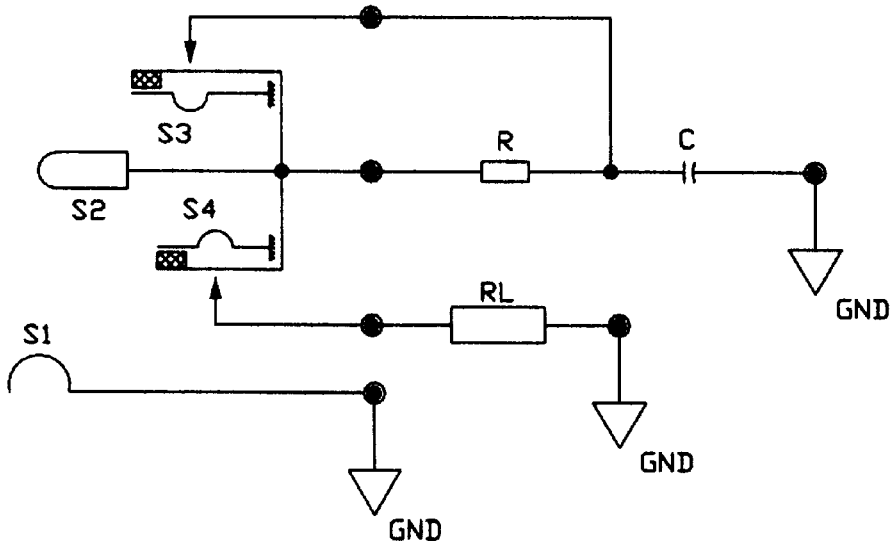
FIG. 7 is a diagram showing an electrical circuit to which the power jack is connected, and a relationship between the power jack and the electrical circuit.

FIG. 7 shows one preferable electrical circuit provided by the user (i.e., the board manufacturer) for implementation of the invention, to which the jack 100 is connected, and an associated relationship between the jack 100 and the electrical circuit. The electrical circuit includes a resistor R, a capacitor C, a load RL and a ground circuit GND.

When the plug 200 is inserted into the jack 100, firstly the conductive sleeve 220 of the plug 200 electrically contacts the first contact point S1 which refers to the ground contact 20. Then the terminal 230 of the plug 200 electrically contacts the second contact point S2 which refers to the-touch post 31 of the center contact 30, whereupon electrical power flows from the plug 200 via the center contact 30 and the resistor R to charge the capacitor C. Then, the conductive sleeve 220 of the plug 200 pushes the third contact point S3 which refers to the conductive contact 41. This causes the arm 62 of the joining member 60 to electrically connect with the resistor R and the capacitor C at a point between the resistor R and the capacitor C. Thereupon the power flows from the protrusions 321 of the plate 32 through the beam 61 of the joining member 60, the arm 62 and the conductive contact 41 to directly charge the capacitor C. Finally, the conductive sleeve 220 of the plug 200 pushes the fourth contact point S4 which refers to the conductive contact 42. This causes the arm 63 of the joining member 60 to electrically connect with the load RL.

As soon as the arm 63 electrically connects with the conductive contact 42, it can be clearly seen from FIG; 7 that electrical charge stored in the capacitor C immediately flows to the load RL via the resistor R and the conductive contact 42. This is in order to compensate the power from the center contact 30 required for driving the load RL. Thus, a large voltage difference between the central contact 30 and the plug 200 is avoided.

In the preferred embodiment, the total inserted distance of the plug 200 in the jack 100 is approximately 10 mm. Distance D is at least 2.5 mm, to ensure capacitor C can be fully charged before the plug 200 pushes the engaging 521 of the switch contact 52.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A direct-current power jack, comprising:

an insulative housing defining a hole through a front face of the housing for receiving a complementary power plug;

a ground contact received in the housing and having a grounding tab projecting into the hole and a foot adapted for connecting to a circuit board;

a center contact received in the hole and located rearwardly of the ground contact;

a first switch contact received in the housing, the first switch contact having a first engaging portion protruding into the hole and located rearwardly of a front end of the center contact;

a second switch contact received in the housing, the second switch contact having a second engaging portion protruding into the hole and located rearwardly of the first engaging portion;

a joining member received in the housing, electrically connecting with the center contact and moveably connected with the first and second switch contacts; and first and second conductive contacts received in the housing and electrically engageable with the joining member; wherein the joining member has a beam and two arms extending from opposite ends of the beam an insulative block is attached to a front end of each of the arms, and each insulative block is moveably connected with a corresponding switch contact; wherein the center contact has a front post and a rear plate, the rear plate has at least one protrusion at a top thereof, and each protrusion electrically engages with the beam of the joining member; wherein the housing comprises two cutouts at opposite sides of the hole, each cutout receives a corresponding switch contact, a corresponding arm of the joining member and a corresponding conductive contact, and each arm is located between a corresponding switch contact and a corresponding conductive contact; wherein the housing comprises an annular interface portion at a front thereof, a mounting slot portion is defined in a bottom of the interface portion, and the ground contact is received in the mounting slot portion.

* * * * *